United States Patent [19]

Scharrer et al.

[11] Patent Number: 5,036,888

[45] Date of Patent: Aug. 6, 1991

[54] CLOSURE CAP FOR A CONTAINER PIPE

[75] Inventors: Konrad Scharrer, Schalbruch 40 b, D-4010 Hilden; Josef Weichselbaumer, Am Kastell 6, D-8072 Manching, both of Fed. Rep. of Germany

[73] Assignees: Konrad Scharrer, Langenfeld; Josef Weichselbaumer, INgolstadt, both of Fed. Rep. of Germany

[21] Appl. No.: 494,766

[22] Filed: Mar. 16, 1990

[30] Foreign Application Priority Data

Mar. 23, 1989 [DE] Fed. Rep. of Germany ... 8903708[U]

[51] Int. Cl.[5] ..... F16L 55/10; B65D 51/16

[52] U.S. Cl. ..... 138/89; 220/203; 220/303; 220/DIG. 32

[58] Field of Search ..... 138/89, 90; 220/303, 220/203, DIG. 32, 301, 295, 298; 137/393, 395

[56] References Cited

U.S. PATENT DOCUMENTS

| | | | |
|---|---|---|---|
| 1,839,029 | 12/1931 | Horan et al. | 138/89 |
| 2,203,801 | 6/1940 | Swank | 220/DIG. 32 |
| 3,974,936 | 8/1976 | Gerdes | 220/DIG. 32 |
| 4,185,751 | 1/1980 | Moore et al. | 220/DIG. 32 |
| 4,913,303 | 4/1990 | Harris | 220/203 |

FOREIGN PATENT DOCUMENTS

| | | | |
|---|---|---|---|
| 2361275 | 4/1978 | France | 220/DIG. 32 |

*Primary Examiner*—James E. Bryant, III

[57] ABSTRACT

A cap for the pipe of an automobile radiator or the like includes a pressure/vacuum valve. The pressure at which the valve opens may be adjusted by an easily operated means permitting adjustment of the compression of a pressure spring, thereby making it possible to reduce the effect of spring tolerances on opening pressure tolerances.

7 Claims, 1 Drawing Sheet

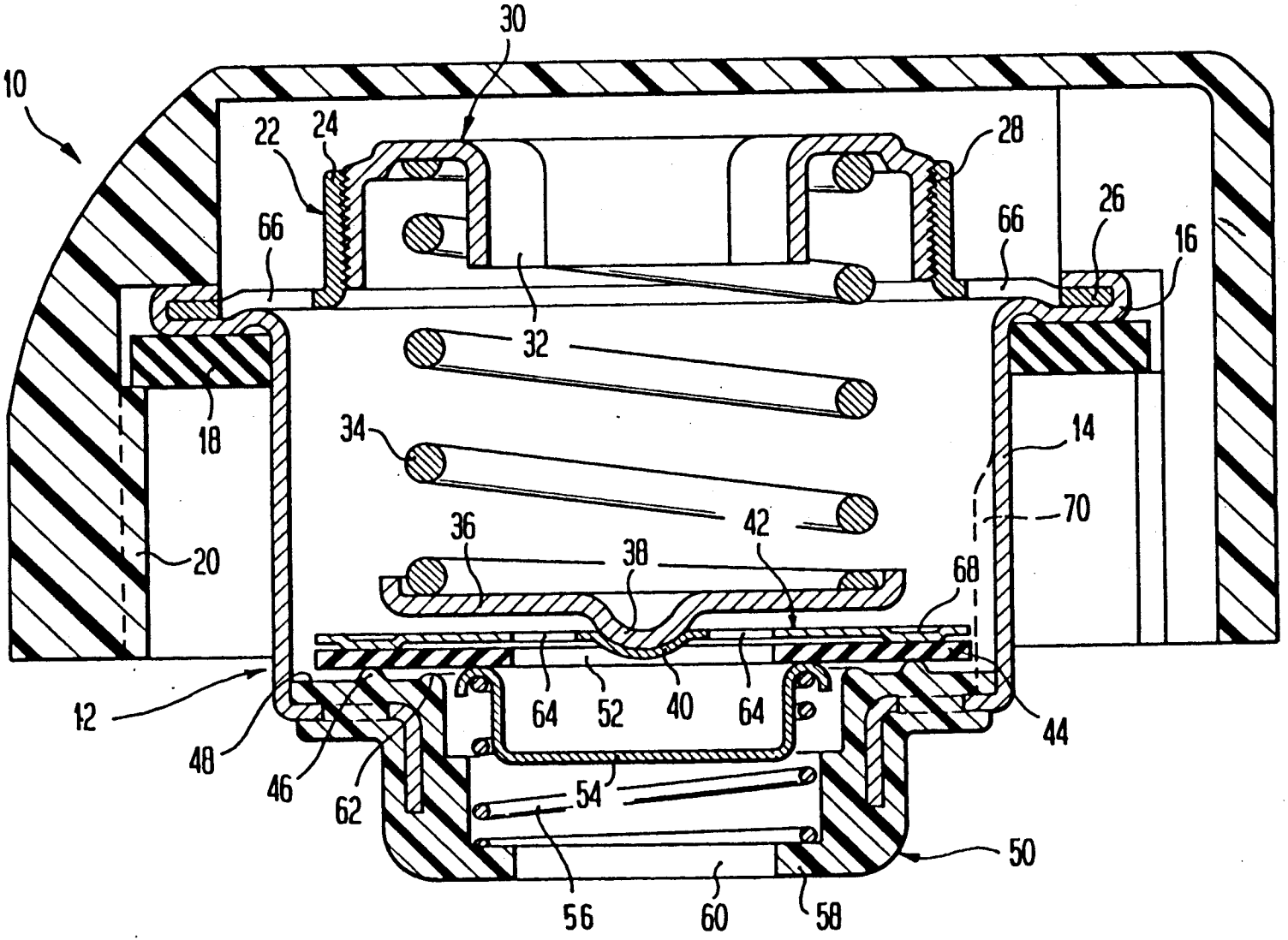
10
12
14
16
18
20
22
24
26
28
30
32
34
36
38
40
42
44
46
48
50
52
54
56
58
60
62
64
66
68
70

CLOSURE CAP FOR A CONTAINER PIPE

FIELD OF THE INVENTION

The invention relates to a closure cap for a container pipe, and deals more particularly with such a cap including a pressure/vacuum valve and useable for example as an automobile radiator cap.

The cap in question is still more particularly of the type including a cover and having connected to the cover a cup shaped inner part with a radially outwardly directed annular flange carrying an annular sealing ring intended to engage the end edge of the pipe, the cap also having a pressure/vacuum valve including an annular sealing membrane which with its inner surface facing the interior of the container lies against both an annular sealing surface of the inner part and a closure part of smaller diameter than said sealing surface covering the middle opening of the sealing membrane, which closure part is urged against said inner surface of said sealing membrane by a vacuum spring engaging the bottom of said inner part, and against the outwardly facing surface of which sealing membrane lies a support against said inner surface of said sealing membrane by a vacuum spring engaging the bottom of said inner part, and against the outwardly facing surface of which sealing membrane lies a support disc under the force of a pressure spring.

BACKGROUND OF THE INVENTION

In the case, for example, of automobile radiator caps the industry today requires pressure tolerances of 0.1 bar for the opening of the pressure/vacuum valve by the pressure or vacuum existing in the container. This requirement is difficult to obtain with normal springs since their tolerances in general lead to too great pressure tolerances.

The invention has as its object therefore the provision of a cap of the aforementioned type whereby in a simple way and without the use of special springs it can be achieved that the pressure/vacuum valve is opened by a pressure value lying within narrowly prescribed limits.

This object is solved in accordance with the invention in that the compression of the pressure spring is adjustable. Therefore the opening pressure of the pressure/vacuum valve can be exactly adjusted. The tolerances of the employed spring therefore play no role.

The adjustment of the compression of the pressure spring can be achieved, in a simple way, by the pressure spring being made from a helical spring which engages with its end remote from the sealing membrane a support body provided with threads and engaged with mating threads on the inner part so as to be adjustable in the axial direction of the pressure spring. Preferably the support body is formed as a ring with a U-shaped profile whose radially inner wall is received in the interior of the helical pressure spring and defines a polygonal opening and whose radially outer wall on its outer side carries the threads making it threadable into a correspondingly threaded cylindrical portion of the inner part. The radially inner wall can, for example, be formed as an hexagonal surface so that the support body can be easily turned by an hexagonal key inserted into the opening, and so that the compression of the spring can in this way be adjusted. The helical spring used as the pressure spring is ground at its end surfaces to provide flat bearing surfaces. To achieve a uniform distribution of the pressure of the pressure spring onto the flexible support disk, in accordance with the invention the pressure spring at its end turned toward the sealing membrane engages a plate supported on the flexible support disc by means of a ball joint. For such ball point the plate can have a ball shaped protrusion in its center mating with a corresponding ball shaped depression in the support disk.

Further features and advantages of the invention will be apparent from the claims and from the following description of the invention as explained in association with the accompanying drawing showing an exemplary embodiment.

BRIEF DESCRIPTION OF THE DRAWING

The single FIGURE of the drawing is a partially schematic cross section taken through the axis of a radiator cap embodying the invention.

DETAILED DESCRIPTION OF THE PREFERRED EMBODIMENT

The radiator cap illustrated by the drawing includes an outer cover 10, usually made of plastic, and an inner part indicated generally at 12 and connected with the cover 10 in a non-illustrated way. The inner part 12 consists of a cup-shaped lower section 14 with a radially outwardly directed flange 16, which flange bears against an annular seal 18 intended to rest on the end edge of a non-illustrated container pipe to be closed by the radiator cap. The annular seal 18 is held to the inner side of the cover 10 by axially extending ribs 20, so that it can not be displaced from the flange 16. The lower section 14, made of sheet metal, is connected with an upper section 22 likewise made of sheet metal and having a cylindrical portion 24 and a ring portion 26 protruding radially outwardly therefrom. This ring portion 26 rests on the side of the flange 16 facing away from the annular seal and is rigidly connected with the lower section 14 by an inwardly turned-over edge of the flange 16, as illustrated in the figure.

The cylindrical portion 24 is provided with an internal thread 28. An externally threaded carrier ring 30 having a U-shaped cross-section is threaded into the cylindrical portion. The radially inner wall 32 of the ring 30 is formed as an internal hexagonal surface, so that the middle opening of the ring can receive an hexagonal key through the help of which the ring can be turned in the threaded cylindrical portion 24. The ring 30 serves in the illustrated way as an abutment for a helical spring 34 which at its end remote from the ring 30 engages a plate 36. The plate 36 at its center has a ball shaped protrusion 38 which mates with a ball-shaped seat 40 in a flexible support disk 42. The flexible support disk 42 rests on an annular sealing membrane 44. The sealing membrane 44 rests on an annular rib 46 formed on a radially inwardly directed shoulder 48 on the lower end of the inner part 12. The annular rib 46 is made of one piece with a plastic part 50 formed by injection molding around the lower end of the lower section 14.

The middle opening 52 of the annular sealing member 44 is closed by a closure part in the form of a flat sheet metal cup 54 surrounded by a helical compression spring 56 engaging the cup on its radially outwardly directed edge, which spring at its opposite end engages a radially inwardly directed section 58 of the plastic part 50.

The so far described radiator cap works under the influence of vacuum or pressure in the container closed by it in the following ways:

If a vacuum exists in the container closed by the radiator cap, the vacuum is applied to the spring cup 54 through the opening 60 in the bottom of the inner part 12 and draws the spring cup 54 toward the interior space of the container against the effect of the vacuum spring 56. The sealing membrane first follows this movement to a certain extent until it abuts an annular rib 62 lying radially between the annular rib 46 and the edge of the spring cup 54, and upon further movement of the spring cup 54 the sealing membrane is removed from the spring cup. In this way a connection between the container inner space and the outside world is created which connection leads through the opening 60 in the inner part 12, the intermediate space between the sealing membrane 44 and the edge of the spring cup 54, the middle opening 52 in the sealing membrane 44, openings 64 in the support disk 42, and openings 66 in the upper section of the inner part.

A pressure existing in the container inner space likewise works against the spring cap 54 and lifts this, along with the sealing membrane 44, the support disk 42 and the plate 36, against the force of the pressure spring 44 upwardly from the annular rib 46, so that through the bottom opening 60 of the inner part and the openings 66 in the upper section of the same a connection between the container inner space and the outside world is created. Moreover, according to how strongly the pressure spring 34 is compressed by the turning in or turning out of the ring 30 relative to the cylindrical portion 24 the so formed pressure/vacuum valve will open with a more or less strong pressure in the container inner space. The opening pressure can therefore be exactly adjusted for the built in spring and is no longer dependant on the tolerances of the spring.

Furthermore, an annular corrugation is formed in the support disk 42 near its edge, which corrugation rests on the sealing membrane and whose average diameter corresponds to the average diameter of the annular rib 46. This annular corrugation therefore provides that the pressure of the support disk 42 is applied to the sealing membrane 44 in the area of the annular rib 46. A good centering of the sealing membrane 44 and of the support disk 42 is assured by centering ribs 70 formed on the inner side of the cup shaped lower section 14 of the inner part 12.

We claim:

1. A closure cap for a container pipe having an end edge, said cap comprising a cover, a cup-shaped inner part connected with the cover and having a radially outwardly directed annular flange carrying a sealing ring for engaging the pipe edge, a pressure/vacuum valve including an annular sealing membrane having a middle opening, and said valve also including a closure part covering said middle opening, said sealing membrane having an inner surface directed toward the container inner space and resting on an annular sealing surface of said inner part and on said closure part, said closure part being urged by a vacuum spring toward said inner surface of said sealing membrane and which vacuum spring engages the bottom of said inner part, said sealing membrane having an outer surface opposite said inner surface, a support disc engaging said outer surface of said sealing membrane, a pressure spring urging said support disc toward said outer surface of said sealing membrane, and means for adjusting the compression of said pressure spring.

2. A closure cap according to claim 1 further characterized by said pressure spring being a helical spring having an end remote from said sealing membrane which engages a support body having first threads threadedly engaging corresponding second threads on said inner part so that said support body is adjustable parallel to the axial direction of said pressure spring.

3. A closure body according to claim 2 further characterized in that said support body is a ring with a U-shaped profile, said ring having a radially inner wall defining a polygonal opening and having a radially outer wall carrying said first threads, said inner part having a cylindrical portion carrying said second threads.

4. A closure cap according to claim 1 further characterized in that said pressure spring with its end turned toward said sealing membrane engages a plate supported on said support disk by a ball joint.

5. A closure cap according to claim 4 further characterized in that said support disk has an annular corrugation extending toward said sealing membrane, said corrugation having an average diameter closely similar to the average diameter of said annular sealing surface on said inner part.

6. A closure cap according to claim 1, further characterized in that said support disk has at least one opening radially inside of said middle opening of said sealing membrane.

7. A closure cap according to claim 1 further characterized in that said sealing surface on said inner part is formed as an annular rib and in that radially between said rib and said closure part is a second somewhat flatter annular rib on said inner part.

* * * * *